United States Patent [19]

Moore et al.

[11] 4,110,554

[45] Aug. 29, 1978

[54] BUOYANT TETHER CABLE

[75] Inventors: Boyd B. Moore; Clarence E. Kendall, Jr., both of Houston, Tex.

[73] Assignee: Custom Cable Company, Houston, Tex.

[21] Appl. No.: 875,953

[22] Filed: Feb. 8, 1978

[51] Int. Cl.[2] ..... H01B 7/12; H01B 11/18

[52] U.S. Cl. ..... 174/101.5; 174/115; 174/116

[58] Field of Search ..... 174/27, 70 R, 101.5, 174/113 R, 115, 116

[56] References Cited

U.S. PATENT DOCUMENTS

| | | | |
|---|---|---|---|
| 3,023,267 | 2/1962 | Rubenstein et al. | 174/115 |
| 3,433,890 | 3/1969 | Gabriel et al. | 174/27 |
| 3,483,313 | 12/1969 | Schaffhauser | 174/113 R |
| 3,517,110 | 6/1970 | Morgan | 174/116 |
| 3,699,237 | 10/1972 | Melia | 174/115 |
| 3,843,568 | 10/1974 | Woodland et al. | 174/116 |

FOREIGN PATENT DOCUMENTS

| | | | |
|---|---|---|---|
| 533,198 | 11/1956 | Canada | 174/113 R |
| 176,974 | 8/1961 | Sweden | 174/113 R |
| 1,364,895 | 8/1974 | United Kingdom | 174/101.5 |

*Primary Examiner*—J. V. Truhe

*Assistant Examiner*—John H. Bouchard

*Attorney, Agent, or Firm*—Fulbright & Jaworski

[57] ABSTRACT

A flexible, high load bearing, electrically conductive buoyant tether cable includes a center stress core having a plurality of jacketed stress bearing members which are in turn enclosed within a plastic-like core jacket. Seven conductor elements are cabled around the core, including three pairs of conductor elements and a jacketed coaxial cable. Each of the conductor element pairs includes a core, five twisted pairs of individually insulated, electrically conductive wires cabled around the conductor element core and a conductor tape binder surrounding the cabled pairs of wires. The conductor elements are cabled around the center stress core and are themselves enclosed by an outer tape binder and jacket. A plurality of intersticial stress members occupies a portion of the corresponding interstices between the cabled conductor elements and the outer tape binder. The interstices within the central stress bearing elements remain hollow for buoyancy while all other interstices within the tether cable are substantially filled with thin walled, hollow glass microspheres for increased buoyancy of the cable which tends to prevent the collapse of the cable from pressure when used in deep water operations.

14 Claims, 2 Drawing Figures

BUOYANT TETHER CABLE

PRIOR ART STATEMENT

In underwater operations, it is frequently necessary to tether an underwater device such as a remote controlled underwater vehicle. The tether cable must necessarily contain within it all means for carrying electrical signals to and from the underwater device. The electrical conductors often include circuitry for powering the remote controlled vehicle as well as a coaxial cable suitable for operating a television camera mounted in the remote controlled vehicle. It is desired that the tether cable have positive buoyancy in order that it will not rest on the ocean bed or become entangled with structures situated thereon. Positive buoyancy also tends to prevent the tether cable from becoming entangled with any part of the vehicle. The tether cable must be capable of bearing a high tensional load as well as side loads or radial loads when the tether cable is wound upon a reel device or driven between two sheaves.

Historically, attempts to provide positive buoyancy for load bearing, electrically conductive floating cables have utilized three methods of construction:

(1) A hollow tube;

(2) jacket and insulation material made with microspheres; and (3) cellular components.

The hollow tube construction temporarily has sufficient buoyancy and can be made to bear sufficient tensional loads, but in deeper waters the hollow tube compresses and mechanically collapses. The result is a loss of buoyancy in deep waters and often a loss of electrical conduction. Another method of construction has involved the extrusion of a cellular plastic or rubber insulation material around the electrical conductors in order to give buoyancy to the tether cable. The cellular extrusion of the insulating material greatly weakens it, causing it to take on a spongy texture and hence the material incurs a compression set thereby collapsing under the high pressures of deep water, in which case buoyancy is lost. Furthermore, the material tends to crush when used with mechanical handling equipment.

Attempts have been made to produce a floating tether cable by extruding a plastic-like material mixed with thin walled, hollow-glass microspheres onto three copper conductor elements and a coaxial cable. Shortcomings of this design include reduced flexibility resulting from the large diameter of the elements and the thickness of the floatation material. An even greater shortcoming involves the microspheres embedded in the extruded jacket which results in a jacket of poor physical properties because the jacket tears easily and is unable to resist abrasion.

SUMMARY OF THE INVENTION

The present invention involves a high-tensional load bearing, electrically conductive buoyant tether cable having within it a core which is made up of a plurality of jacketed stress members enclosed within a core tape binder. The interstices within the stress bearing elements remain hollow while the interstices among the stress bearing elements and the core tape binder are filled with a quantity of microspheres for increased buoyancy. A plurality of conductor elements are cabled around the center stress core. For three-phase electrical power, the conductor elements preferably include three pairs of conductor elements plus a coaxial cable. Each of the pairs of the conductor elements includes: a low-density, high-strength plastic core which can be either a solid, hollow, or low-density polyethylene tube extruded onto a twisted polypropylene fiber core; five twisted pairs of insulated copper wires cabled around the conductor core; and a plastic-like tape binder surrounding the cabled twisted pairs of copper wires. The microspheres substantially fill the interstices between the conductor core and the twisted pairs of wires and the conductor element. A low density, high strength plastic-like material surrounds the coaxial cable for increased buoyancy and symmetry of design. An outer tape binder surrounds the cabled conductor elements. An outer jacket surrounds the entire assembly. Interstices between the outer tape binder and the cabled elements are partially occupied by interstitial stress members, similar to the stress bearing elements in the core, but which are not jacketed. The remainder of the interstices between the outer tape binder and the conductor elements, as well as the conductor elements and the core, are substantially filled with microspheres to increase the buoyancy of the tether cable and reinforce it against collapse caused by high hydrostatic pressures occurring in deep water.

It is therefore an object of the present invention to provide a tether cable having high tensional load bearing characteristics suitable for deep water operations.

Another object of the present invention is to provide sufficient electrical conduits within the tether cable to operate an underwater device.

Still another object of the present invention is to provide a positively buoyant tether cable containing the plurality of electrical conduits, and tensional stress bearing members, with the overall specific gravity of the tether cable sufficiently low for it to be buoyant and to float on the water's surface.

An even further object of the present invention is to provide a buoyant, electrically conductive, stress bearing tether cable which retains its configuration and its buoyant characteristics in deep water.

Still another object of the present invention is to arrange the conductor elements, the core and the interstitial stress members so that the integrity of the buoyant tether cable is maintained when high radial compression loading is applied to the tether cable as the tether cable is retrieved onto a reel device.

Still another object of the present invention is to provide a positively buoyant cable having a maximum flexibility and a minimum diameter.

These and other objects of the present invention will become readily apparent upon examination of the specifications, the claims and the drawings appended hereto.

DESCRIPTION OF THE PREFERRED EMBODIMENT

Figure 1:
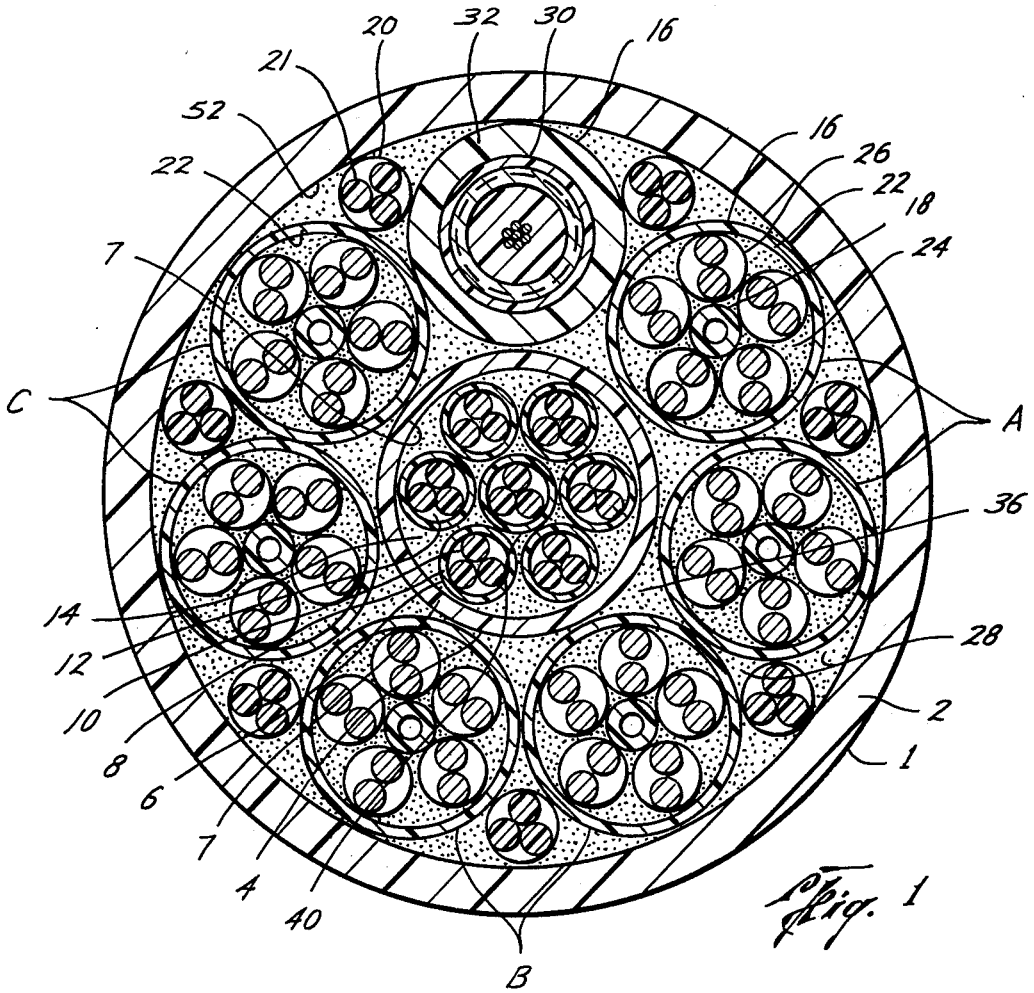
FIG. 1 is a sectional view of one embodiment of the buoyant tether cable having hollow conductor element cores, the view taken along the longitudinal axis of the cable.

The buoyant tether cable 1 has a center stress core 4. The center stress core 4 has a plurality of stress bearing elements 6 contained within a core tape binder 7. Preferably, six stress bearing elements 6 are cabled around a central core element 40 in a six around one configuration. For ease of manufacture, the central core element 40 can be identical to each of the stress bearing elements 6. It is understood by those skilled in the art that one large stress bearing element could replace the individual stress bearing elements 6 and central core element 40 to achieve the same tensional load bearing capability. For increased buoyancy, the present core configuration is preferred.

Each stress-bearing element is preferably composed of three-stress bearing members 10 twisted among themselves which are, in turn, contained within a jacket 8. Accordingly, interstices are formed between the stress-bearing members 10 and each jacket 8 which remain unfilled in order to increase the overall buoyancy of the tether cable 1. The stress-bearing members 10 are preferably composed of an impregnated aramid fiber while the jacket 8 is preferably a low specific gravity plastic.

The six around one cabled configuration of the stress-bearing elements 6 and central core element 40 forms inner interstices 14 among the stress-bearing elements 6, the central core element 40 and the core tape binder 7. A quantity of thin walled, hollow-glass microspheres is located within the inner interstices 14 in order to increase the integrity of the shape of the center stress core 4 when the core is subject to radial compression. The microspheres are more easily applied to the interstices 14 during the manufacture of the cable if they are combined with a silicone oil medium, preferably in a 70% microsphere to 30% silicone oil ratio by volume, after which process the core tape binder 7 is applied to the configuration.

The stress-bearing members 10, composed of an aramid fiber, have a specific gravity of approximately 1.39, and provide a high tensile strength for their specific gravity. The interstices 12, the microspheres in the interstices 14 and the jackets 8 around the stress bearing members 10 each provide a specific gravity of less than one so that the higher specific gravity of the aramid fibers is offset, thereby resulting in a buoyant center stress core 4.

A plurality of conductor elements 16 is cabled around the center stress core 4. Any number or combination of conductor elements 16 including, for example, a coaxial cable 30 inside a coaxial jacket 32 may be cabled around the core 4. Preferably, the outer diameters of all conductor elements 16 are substantially the same in order to retain the integrity and shape of the tether cable 1 under radial and tensional loads.

Figure 2:
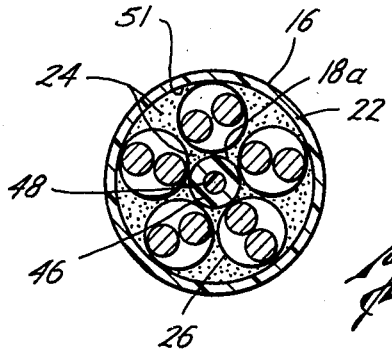
FIG. 2 is a second mode of construction of a conductor element showing the conductor element core as a plastic-like material tube extruded onto a fiber-like core.

In FIG. 1 there are shown three pairs of conductor elements including a first pair A, a second pair B, and a third pair C. The three pairs of conductor elements A, B and C of FIG. 1 can be identical and are suitable for supplying three phase electrical power to a tethered vehicle. Pair A supplies one phase of electrical power while pair B supplies the second phase and pair C the third phase. The conductor core 18 of each conductor element 16 (excepting the seventh conductor element which is a coaxial cable 30 inside a coaxial jacket 32) can be a low-density polyethylene material tube extruded onto a twisted polypropylene fiber core shown in FIG. 2 as 18*a*, or a hollow low density, high strength plastic for increased buoyancy shown in FIG. 1 as 18. The conductor element core 18*a* is preferably a tube extrusion of low density polyethylene 46 over a twisted polypropylene fiber core 48. The latter construction contains minute air pockets within the twisted polypropylene fiber core 48, thus producing sufficient tensional load-bearing characteristics while yielding a specific gravity of less than one.

Cabled around the conductor element core 18 or 18*a* within each conductor element 16 are five insulated, twisted pairs of conductive wires 26. Each wire of the twisted pair of wires 26 is insulated with a plastic-like material having a specific gravity of less than one in order to increase buoyancy of the conductor element 16. It is understood that one large copper wire can replace the five twisted pairs of wires 26, but the present arrangment as described and shown in FIG. 1 provides for greater strength and flexibility over a solid wire while at the same time maximizing the number of interstices 24 between the conductor element core 18 or 18*a*, the twisted pairs of wires 26 and the low density, high strength plastic-like conductor tape binder 22. The interstices 24 are substantially filled with microspheres in order to increase the buoyancy of each conductor element 16 while retaining sufficient internal structure within a conductor element 16 to prevent collapse of the conductor element 16 from radial loading.

An outer tape binder 52 circumferentially surrounds the plurality of conductor elements 16 which are cabled around the center stress core 4. Accordingly, mid-interstices 36 are formed between the center stress core 4 with the conductor elements 16 cabled around the core and outer interstices 28 are formed between the cabled conductor elements 16 and the outer tape binder 52. Within each outer interstice 28, is an intersticial stress member 20. Each intersticial stress member 20 contains at least two outer stress-bearing members 21 twisted between or among themselves and cabled within the outer interstices 28 in conformity with the cabled conductor elements 16. Each intersticial stress member 20 can be enclosed in a jacket (not shown) of a high strength, low density plastic-like material similar to the jackets 8. The mid-interstices 36 and the portion of the outer interstices 28 not occupied by the intersticial stress members 20 are substantially filled with a quantity of microspheres identical to those microspheres substantially filling the volumes of the interstices 24 and the inner interstices 14. The presence of the microspheres within the inner interstices 14, the mid-interstices 36 and the outer interstices 28 produces a honeycombed effect wherein the substantially incompressible microspheres tend to prevent the collapse of the tether cable 1 in deep water and tend to retain the shape of the tether cable 1 under tensional and radial loading of the cable.

FIG. 1 shows three outer stress-bearing members 21 twisted together to form each intersticial stress member 20. Those skilled in the art will realize that the desired load-bearing characteristics of the tether cable 1 in relation to the desired overall specific gravity of the tether cable will determine the diameter of and number of the outer stress-bearing members 21 comprising each intersticial stress member 20. For example, and not by way of limitation, two outer stress-bearing members 21 can be twisted together to comprise each intersticial stress member 20 if the outer diameter of the tether cable 1 is sufficiently small to prevent the use of three or more outer stress-bearing members 21 for each intersticial stress member 20.

An outer jacket 2 circumferentially surrounds the outer tape binder 52. The outer jacket 2 is a high strength plastic-like material having a specific gravity of less than one.

Those skilled in the art will further realize that the coaxial jacket 32 circumferentially surrounds the coaxial cable 30 in order to insure that the conductor element 16, comprised of the coaxial cable 30 and coaxial jacket 32, has an outer diameter substantially the same as the remaining pairs of conductor elements A, B and C. The coaxial jacket 32 can be the same high strength, plastic-like material as used in the jackets 8. The use of a plastic-like material with a specific gravity of less than one for internal jacketing and tape binders in the tether cable 1 contributes to the overall buoyancy of the tether cable. Moreover, when the tether cable 1 is placed under a tensional load, the intersticial stress members 20 tend to minimize elongation of the cable, provide mutual support for the conductor elements, and bear a portion of the tensional load.

A preferred embodiment of the present invention includes a center stress core 4 having six stress-bearing elements 6 cabled around an axially centered core element 40 in a six around one configuration. Each stress-bearing element 6 within the center stress core 4 contains three stress-bearing members 10 twisted within a jacket 8. The stress-bearing members 10 are made of an aramid fiber while the jackets 8 as well as the core tape binder 7 are composed of a high strength plastic-like material having a specific gravity of less than one. The interstices 12 between the stress-bearing members 10 and the jacket 8 remain hollow for increased buoyancy while the inner interstices 14 formed between the core element 40, the stress-bearing elements 6 and the core tape binder 7 are filled with microspheres in a silicone oil medium. Seven conductor elements 16 are cabled around the center stress core 4. The seven conductor elements 16 include a first pair A of conductor elements, a second pair B, a third pair C, and a coaxial cable 30 enclosed within a coaxial jacket 32, the coaxial jacket 32 being a high strength plastic-like material having a specific gravity of less than one. The construction of each conductor element 16 of the conductor element pairs A, B and C is identical. A conductor element core 18 having a low density polyethylene material tube extruded onto a twisted polypropylene fiber core 48 has five twisted pairs of insulated wires 26 cabled around the conductor element core 18. A conductor tape binder 22 surrounds the five twisted pairs of insulated wires 26 and is composed of a high strength plastic-like material with a specific gravity of less than one, similar to or identical to the core tape binder 7, the jackets 8 and the coaxial jacket 32. The interstices 24 within the conductor tape binder 22 are substantially filled with microspheres. An outer tape binder 52 surrounds the cabled conductor elements 16, the intersticial stress members 20 and microspheres. A polyurethane outer jacket 2 surrounds the outer tape binder 52 polyurethane having been selected for its high strength, abrasion-resistant qualities. The outer interstices 28 are each partially occupied by an intersticial stress member 20. Each intersticial stress member 20 includes two twisted outer stress-bearing members 21 made of an aramid fiber similar to the stress-bearing members 10. The mid-interstices 36 and the volume of the outer interstices 28 unoccupied by the intersticial stress members 20 are filled with polyglass microspheres.

The above-described tether cable has been disclosed for purposes of clarity as a preferred embodiment. It is realized that other combinations of structure, arrangements and equivalents of structure fall within both the scope and the spirit of the present invention as claimed hereinafter.

What is claimed is:

1. A high tensile strength electrically conductive buoyant tether cable comprising:

(a) a center stress core having, (i) a plurality of cabled stress-bearing elements having a low density, high strength plastic-like jacket circumferentially defining each stress-bearing element;

(ii) a core tape binder circumferentially enclosing the plurality of inner stress-bearing elements (i);

(iii) a plurality of inner interstices formed by the exterior surfaces of the stress-bearing elements (i) and the core tape binder (ii); and (iv) microspheres substantially occupying the plurality of inner interstices (iii);

(b) a plurality of conductor elements cabled around the center stress core (*a*) including:

(i) a first pair of conductor elements each composed of a plastic-like conductor core, a plurality of twisted insulated wires cabled around said plastic-like conductor core, a conductor tape binder enclosing the plurality of twisted pairs of wires whereby interstices are formed among the twisted pairs of wires, the plastic-like core and the plastic-like conductor tape binder, and a quantity of microspheres substantially occupying said interstices;

(ii) a second pair of conductor elements each substantially identical to the first pair of conductor elements (i);

(iii) a third pair of conductor elements each substantially identical to the first pair of conductor elements (i); and (iv) a coaxial cable having a plastic-like external jacket circumferentially enclosing said coaxial cable;

(c) mid interstices formed by the center stress core (*a*) and the plurality of conductor elements (*b*), said mid interstices substantially filled with microspheres;

(d) an outer plastic-like tape binder circumferentially surrounding and in close proximity to the plurality of conductor elements (*b*) cabled around the core (*a*) such that outer interstices are formed between the conductor elements and the outer tape binder;

(e) at least one interstitial stress member located within and partially occupying each of the outer interstices (*d*);

(f) an outer jacket circumferentially surrounding the outer tape binder (*d*); and (g) a quantity of microspheres occupying the volume of each outer interstices not occupied by an interstitial stress member (*e*) thereby forming a flexible, tensional load bearing, electrically conductive buoyant tether cable suitable for underwater operations.

2. The device of claim 1 wherein each of the cabled stress-bearing elements (*a*) (i) comprises:

(a) three twisted stress-bearing members; and (b) a jacket circumferentially surrounding the twisted stress-bearing members whereby unfilled interstices are formed between the cabled stress-bearing members (*a*) and said jacket.

3. The device of claim 1 wherein the stress-bearing elements comprise six stress-bearing elements cabled around a central core element.

4. The device of claim 1 wherein at least one of the plastic-like cores of the conductor elements (*b*) (i), (ii) and (iii) includes a hollow center for increased buoyancy.

5. The device of claim 1 wherein at least one of the conductor cores of conductor elements (*b*) (i), (ii) or (iii) is a low density polyethylene material tube extruded on a twisted polypropylene fiber core.

6. The device of claim 1 wherein at least one of the plastic-like cores of the conductor elements (*b*) (i) is a low density, high strength plastic-like material.

7. The device of claim 1 wherein at least one of the plastic-like cores of the conductor elements (*b*) (ii) is a low density, high strength plastic-like material.

8. The device of claim 1 wherein at least one of the plastic-like cores of the conductor elements (*b*) (iii) is a low density, high strength plastic-like material.

9. The device of claim 1 wherein the outer jacket (f) is a polyurethane jacket.

10. The device of claim 1 wherein the first pair of conductor elements (*b*) (i) is electrically parallel.

11. The device of claim 1 wherein the second pair of conductor elements (*b*) (ii) is electrically parallel.

12. The device of claim 1 wherein the third pair of conductor elements (*b*) (iii) is electrically parallel.

13. A high tensional load bearing, electrically conductive, buoyant tether cable comprising:

(a) a core having:

(i) a central core element including three twisted stress-bearing members, a low density, high strength plastic jacket circumferentially surrounding said stress-bearing members, and unfilled interstices formed between the three twisted stress-bearing members and the jacket;

(ii) six stress-bearing elements substantially identical to and cabled around the central core element (i) whereby interstices are formed between said six cabled stress-bearing elements and said central core element (i);

(iii) a low density, high strength plastic-like core tape binder circumferentially surround the six cabled stress-bearing elements (ii) and central core element (i) whereby interstices are formed between the cabled stress-bearing elements (ii), the central core element (i) and said tape binder; and (iv) a quantity of microspheres substantially filling the volumes of the interstices formed in (ii) and (iii);

(b) seven conductor elements cabled around the core (a) wherein:

(i) each of a first pair of said conductor elements comprises a low density, high strength plastic-like conductor core, five twisted pairs of insulated conductive wires cabled around the conductor core wherein interstices are formed between the conductor core and the five pairs of twisted wires, a low density, high strength plastic-like conductor tape binder circumferentially enclosing the five twisted pairs of conducting wires cabled around the conductor core whereby interstices remain between the five twisted pairs of conductive wires and said conductor tape binder and a quantity of microspheres substantially fills the interstices formed within each of the first pair of conductor elements;

(ii) each of a second pair of said conductor elements comprises a low density, high strength plastic-like conductor core, five twisted pairs of insulated conductive wires cabled around the conductor core wherein interstices are formed between the conductor core and the five pairs of twisted wires, a low density, high strength plastic-like conductor tape binder circumferentially enclosing the five twisted pairs of conductive wires cabled around the conductor core whereby interstices remain between the five twisted pairs of conductive wires and said conductor tape binder and a quantity of microspheres substantially fills the interstices formed within each of the second pair of conductor elements;

(iii) each of a third pair of conductor elements comprises a low density, high strength plastic-like conductor core, five twisted pairs of insulated conductive wires cabled around the conductor core wherein interstices are formed between the conductor core and the five pairs of twisted wires, a low density, high strength plastic-like conductor tape binder circumferentially enclosing the five twisted pairs of conductive wires cabled around the conductor core whereby interstices remain between the five twisted pairs of conductive wires and said conductor tape binder and a quantity of microspheres substantially fills the interstices formed within each of the third pairs of conductor elements; and (iv) a conventional coaxial cable having a low density, high strength plastic-like jacket contiguous to and circumferentially enclosing said coaxial cable;

(c) an outer tape binder circumferentially enclosing the seven cabled conductor elements (*b*);

(d) interstices formed between the seven conductor elements (*b*) and the core (*a*);

(e) interstices formed between the seven cabled conductor elements (*b*) and the outer tape binder (*c*);

(f) a two-strand twisted aramid fiber stress member cabled into each interstice (*e*); and (g) a quantity of microspheres substantially occupying the volume of the interstices (*d*) and the unoccupied volume of the interstices (*e*); and (h) a urethane outer jacket circumferentially surrounding the outer tape binder (*c*).

14. The device of claim 13 wherein at least one of the conductor cores of conductor elements (*b*) (i), (ii) or (iii) is a low density polyethylene material tube extruded on a twisted polypropylene fiber core.

* * * * *